US007172039B2

(12) United States Patent
Teale et al.

(10) Patent No.: US 7,172,039 B2
(45) Date of Patent: Feb. 6, 2007

(54) DOWN-HOLE VANE MOTOR

(75) Inventors: David Warren Teale, Spring, TX (US); Greg Marshall, Magnolia, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 163 days.

(21) Appl. No.: 10/696,489

(22) Filed: Oct. 29, 2003

(65) Prior Publication Data

US 2005/0092525 A1 May 5, 2005

(51) Int. Cl.
*E21B 4/02* (2006.01)
*F01C 21/18* (2006.01)

(52) U.S. Cl. ..... 175/100; 175/102; 175/107; 418/188; 418/225; 418/266

(58) Field of Classification Search ..... 175/92, 175/100, 107, 57, 102; 166/312; 418/113, 418/188, 249, 225, 266–268
See application file for complete search history.

(56) References Cited

U.S. PATENT DOCUMENTS

| | | | | |
|---|---|---|---|---|
| 2,688,287 | A * | 9/1954 | Burrows et al. | 418/258 |
| 3,388,755 | A * | 6/1968 | Webb | 175/297 |
| 3,782,867 | A * | 1/1974 | Gerlach et al. | 418/82 |
| 3,838,953 | A | 10/1974 | Peterson | |
| 5,030,071 | A * | 7/1991 | Simpson | 418/13 |
| 5,083,909 | A * | 1/1992 | Kunsemiller et al. | 418/102 |
| 5,171,139 | A | 12/1992 | Underwood et al. | |
| 5,460,496 | A | 10/1995 | Susman et al. | |
| 5,733,113 | A | 3/1998 | Grupping | |
| 5,785,509 | A | 7/1998 | Harris et al. | |
| 5,833,444 | A | 11/1998 | Harris et al. | |
| 6,302,666 | B1 | 10/2001 | Grupping | |
| 6,499,976 | B1 | 12/2002 | McPhate et al. | |
| 6,520,271 | B1 | 2/2003 | Martini | |
| 2003/0132031 | A1 | 7/2003 | Schauerte | |

FOREIGN PATENT DOCUMENTS

| | | | |
|---|---|---|---|
| GB | 2059481 A | * | 4/1981 |
| GB | 2 159 580 | | 12/1985 |
| GB | 2292186 A | * | 2/1996 |

OTHER PUBLICATIONS

U.K. SearchReport, Application No. GB024067.5, dated Jan. 10, 2005.
G.B. Search, Application No. GB0424087.5, dated Oct. 2, 2006.

* cited by examiner

*Primary Examiner*—Kenneth Thompson
(74) *Attorney, Agent, or Firm*—Patterson & Sheridan, L.L.P.

(57) ABSTRACT

The present invention generally relates to an apparatus and method for use in a wellbore. In one aspect, a downhole tool for use in a wellbore is provided. The downhole tool includes a housing having a shaped inner bore, a first end and a second end. The downhole tool further includes a rotor having a plurality of extendable members, wherein the rotor is disposable in the shaped inner bore to form at least one chamber therebetween. Furthermore, the downhole tool includes a substantially axial fluid pathway through the chamber, wherein the fluid pathway includes at least one inlet proximate the first end and at least one outlet proximate the second end. In another aspect a downhole motor for use in a wellbore is provided. In yet another aspect, a method of rotating a downhole tool is provided.

33 Claims, 10 Drawing Sheets

DOWN-HOLE VANE MOTOR

BACKGROUND OF THE INVENTION

1. Field of the Invention

Embodiments of the present invention generally relate to wellbore completion. More particularly, the invention relates to downhole tools. Still more particularly, the invention relates to a downhole vane motor.

2. Description of the Related Art

In a conventional well completion operation, a wellbore is formed by drilling a hole to a predetermined depth to access hydrocarbon-bearing formations. Drilling is accomplished utilizing a drill bit which is mounted on the end of a drill support member, commonly known as a drill string. The drill string is often rotated by a top drive or a rotary table on a surface platform or rig. Alternatively, the drill bit may be rotated by a downhole motor, such as by a positive displacement motor (pdm) or a conventional vane motor.

The conventional vane motor is well known in the art, such as described in U.S. Pat. No. 5,518,379, issued to Harris et al., on May 21, 1996, which is herein incorporated by reference in its entirety. The conventional vane motor and the positive displacement motor are typically powered by a fluid, such as drilling mud, which is pumped through a non-rotating drill string. The conventional vane motor is primarily used in applications involving commingled fluids (nitrogen & drilling mud), high temperature applications, and under balanced drilling applications. Conventional vane motors have an advantage over the positive displacement motor in these instances because they can effectively operate in a corrosive downhole environment. However, these conventional vane type motors have several inherent disadvantages that have limited the use of these tools in the drilling market.

One such disadvantage is that the conventional vane motor has a high output speed. For instance, the conventional vane motor has a rotational speed between 1,500 to 3,000 RPM, as compared to the positive displacement motor which has a rotational speed between 80 to 600 RPM. The high output speed of the conventional vane motor is often times not conducive in removing wellbore material or within a range of speed as dictated by the drill bit designers. The conventional vane motor has a very small displacement volume per revolution resulting in a higher output speed. Therefore, often times, other downhole equipment must be employed, such as a gearbox, to reduce the speed of the conventional vane motor. By employing additional downhole equipment, the overall cost of forming the wellbore is significantly increased.

Another disadvantage is that the conventional vane motor has a low power output. For instance, the conventional vane motor may have a 40% reduction in power as compared to standard pdm of an equivalent size. The conventional vane motor typically includes three required components, a housing, a stator and a rotor. Many times, the size of these components limit the space available for a power fluid chamber, thereby resulting in a small fluid volume chamber. Thus, the low volume characteristics of the conventional vane motor combined with a small surface area per unit pressure results in lower torque output.

Another disadvantage is that the operational life of the conventional vane motor is often times reduced due to the contamination of the internal components by particles circulating through the motor. Additives, such as abrasive particles, are typically added to the drilling mud to maintain the drilling mud properties. These particles must be filtered and prevented from circulating through the conventional vane motor otherwise seals and sealing surfaces will wear at an accelerated rate causing component damage. Typically, additional filter equipment must be installed on the surface along with additional downhole filters to properly filter the drilling fluid; thus, adding to operational costs and introducing additional maintenance and reliability issues.

Another disadvantage is that the conventional vane motor includes many complex parts resulting in a decrease in their reliability and increase in their maintenance costs. For instance, in addition to the housing, the stator, and the rotor as previously discussed, often times the conventional vane motor includes an elaborate shimming arrangement for maintaining the alignment and the tolerances between the components. Furthermore, the time required to service the conventional vane motor is typically 2 to 3 times the standard time that is required to service the pdm motor. This is partly due to the tight tolerances and fine adjustments that make the conventional vane motor impractical to service in a shop environment and in remote locations where tooling and expertise are limited. Drilling operators have dealt with the reliability issues by providing the customer with redundant vane motors. In the event that a vane motor fails, several backup vane motors are made available on location.

Another disadvantage is that the conventional vane motor does not tolerate misalignment due to bending or side load conditions. A large portion of the current drilling market cannot be penetrated with the vane motor technology because the risk factors are high for component failure in a side load condition. For instance, casing exits, side tracks, and special applications must utilize pdm technology to complete jobs. Often times, the pdm is not suited for the application due to high temperature, pressure, or nitrogen requirement.

Various designs have been developed to improve the conventional vane motor. For instance, one design uses rolling elements as sealing members as described in U.S. Pat. No. 6,302,666, issued to Gupping et al., on Oct. 16, 2001, which is herein incorporated by reference in its entirety. In another design, a motor having a stator with a rod recess formed therein is used in conjunction with a rod to act as a valve for opening and closing an inlet/exhaust port, as described in U.S. Pat. No. 5,833,444, issued to Harris et al., on Nov. 10, 1998, which is herein incorporated by reference in its entirety. However, these designs do not address the reliability and performance issues of the conventional vane motor.

A need therefore exists for a vane motor having a lower output speed. There is a further need for a vane motor with an increased power output. There is yet a further need for a simple vane motor that is reliable. Further, there is a need for a vane motor that includes a self cleaning means, thereby minimizing component damage. Furthermore, there is a need for an improved vane motor.

SUMMARY OF THE INVENTION

The present invention generally relates to an apparatus and method for use in a wellbore. In one aspect, a downhole tool for use in a wellbore is provided. The downhole tool includes a housing having a shaped inner bore, a first end and a second end. The downhole tool further includes a rotor having a plurality of extendable members, wherein the rotor is disposable in the shaped inner bore to form at least one chamber therebetween. Furthermore, the downhole tool includes a substantially axial fluid pathway through the chamber, wherein the fluid pathway includes at least one inlet proximate the first end and at least one outlet proximate the second end.

In another aspect, a downhole tool for use in a wellbore is provided. The downhole tool includes a housing having a shaped inner bore, a rotor having a plurality of extendable members disposed on the outer surface thereof. The downhole tool also includes a first fluid pathway through the downhole tool, wherein the fluid pathway includes at least one chamber formed between the shaped inner bore and the rotor. Furthermore, the downhole tool includes a second fluid pathway through the downhole tool, wherein the second fluid pathway is separate from the first fluid pathway.

In yet another aspect, a downhole motor for use in a wellbore is provided. The downhole motor includes a housing having a shaped inner bore, a first end and a second end. The downhole motor further includes a rotor disposable in the shaped inner bore to form at least one chamber therebetween and a plurality of extendable non-circular members. Further, the downhole motor includes a substantially axial fluid pathway through the chamber, wherein the fluid pathway includes at least one inlet at the first end and at least one outlet at the second end.

In yet another aspect, a method for rotating a downhole tool is provided. The method includes placing a tubular string having a motor disposed therein into a wellbore. The motor having a housing, a rotor with a plurality of extendable members, at least one chamber, an inlet, and an outlet. The method also includes extending the members into the at least one chamber to form a substantially flat differential surface area between an outer surface of the rotor and the shaped inner bore. The method further includes pumping fluid through the at least one inlet to pressurize the at least one chamber and creating a force on the substantially flat differential surface area, thereby causing the rotor to rotate. Furthermore, the method includes exhausting fluid through the at least one outlet.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

The present invention is generally directed to a vane motor for use in a wellbore. Various terms as used herein are defined below. To the extent a term used in a claim is not defined below, it should be given the broadest definition persons in the pertinent art have given that term, as reflected in printed publications and issued patents. In the description that follows, like parts are marked throughout the specification and drawings with the same number indicator. The drawings may be, but are not necessarily, to scale and the proportions of certain parts have been exaggerated to better illustrate details and features of the invention. One of normal skill in the art of vane motors will appreciate that the various embodiments of the invention can and may be used to include, but not limited to, a production motor for rotating a downhole tool, such as a drill or mill, a production motor for driving a rotational pump, or as a vane pump driven by a downhole electromotor.

For ease of explanation, the invention will be described generally in relation to a cased vertical wellbore. It is to be understood, however, that the invention may be employed in a horizontal wellbore or a diverging wellbore without departing from principles of the present invention.

Figure 1:
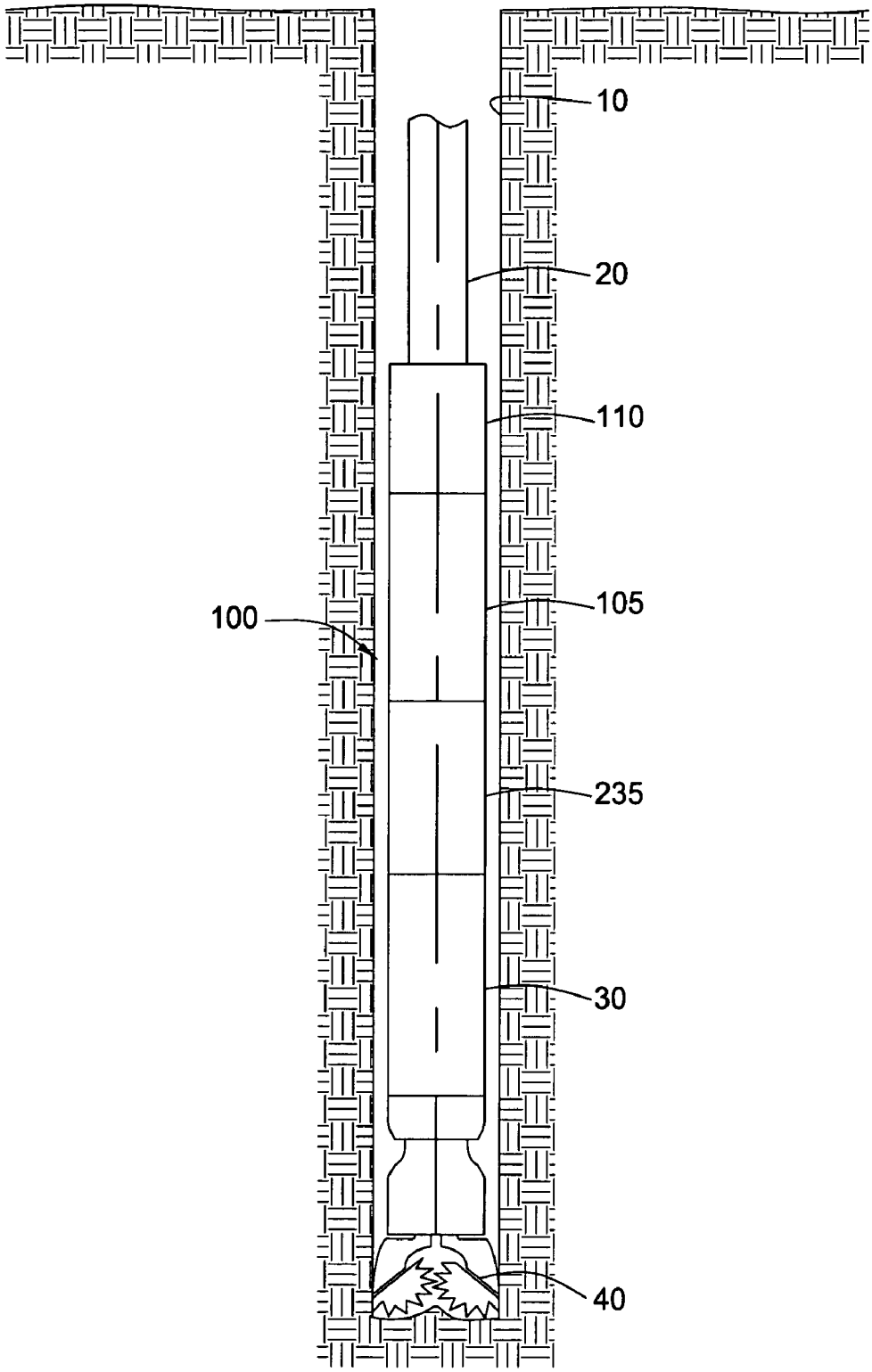
FIG. 1 is a view illustrating a vane motor of the present invention disposed in a wellbore.

FIG. 1 is a view illustrating a vane motor 100 of the present invention disposed in a wellbore 10. The vane motor 100 includes an upper sub 110 for connection to a non-rotating drill string 20. At the lower end of the upper sub 110 is a stator housing 105 to protect the internal components of the vane motor 100 from the abrasive downhole environment of the wellbore 10. At the lower end of the stator housing 105 is a housing adapter 235 for connecting the stator housing 105 to a bearing arrangement 30 and another downhole tool such as a mill or drill bit 40.

Typically, a gas or a fluid, such as drilling mud, is pumped from the surface of the wellbore 100 through the non-rotating drill string 20 into the vane motor 100. Thereafter, the fluid creates a fluid pressure that is converted into a rotational force as will be described in greater detail in subsequent paragraphs. The rotational force is transmitted through the bearing arrangement 30 to the drill bit 40. In other words, the vane motor 100 of the present invention converts a hydraulic fluid force into a rotational force which subsequently rotates the drill bit 40 to form the wellbore 10.

Figure 2:
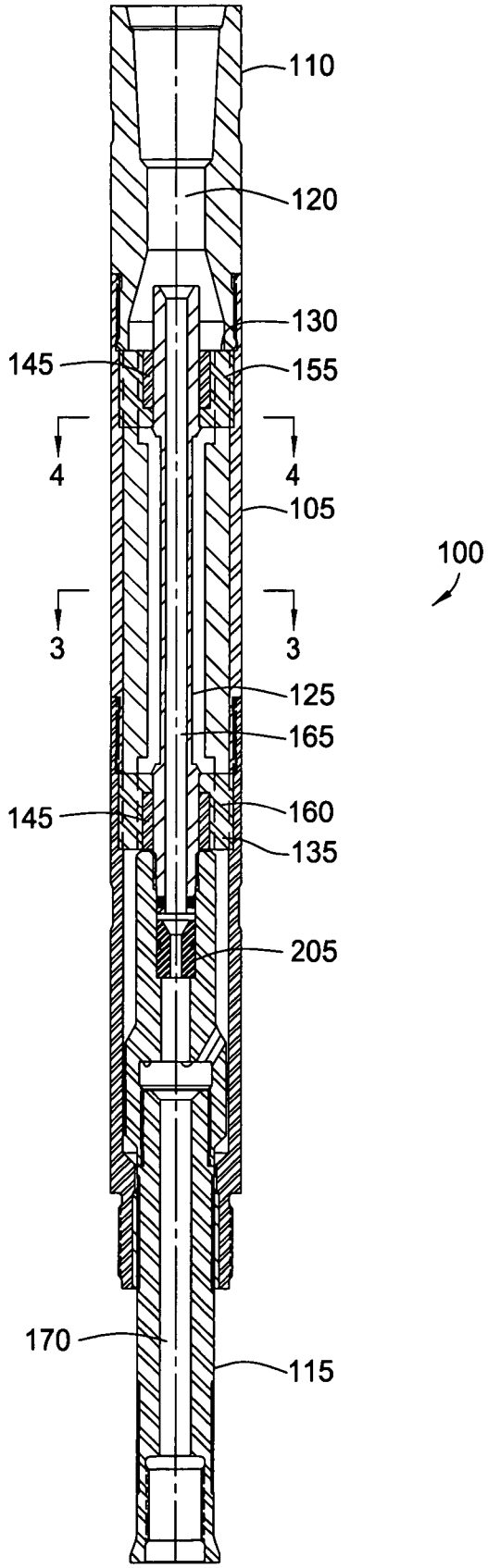
FIG. 2 is a cross-sectional view illustrating the vane motor of the present invention.

FIG. 2 is a cross-sectional view illustrating the vane motor 100 of the present invention. As shown, the upper sub 110 includes a bore 120 therethrough for communication of fluid from the drill string (not shown) into the vane motor 100. Fluid in the bore 120 may flow through an inlet 130 formed in an upper bushing plate 155 into at least one chamber (not shown) and fluid may also flow into a center bore 165. In other words, the vane motor 100 has a split flow arrangement, wherein a predetermined amount of fluid may be directed through a first fluid pathway comprising the inlet 130, the chamber 150, and the outlet 135, and a predetermined amount of fluid may be directed through a second fluid pathway comprising the center bore 165. It should be noted that the second fluid pathway is separate from the first fluid pathway. Furthermore, the first fluid pathway may feed into the second fluid pathway at a point below the outlet 135.

The vane motor 100 of the present invention includes an end feed arrangement to fill and exhaust fluid from the chamber. The end feed arrangement provides a substantially axial fluid pathway. More specifically, fluid enters through the inlet 130 to fill the chamber, thereby creating an instantaneous pressure distribution along the entire length of a plurality of extendable members, such as vanes (not shown), causing the rotor 125 to rotate about its axis. After a predetermined amount of rotation, the fluid exhausts through an outlet 135 formed in a lower busing plate 160 and subsequently through the bore 170 of the coupling 115. Among other things, the end flow arrangement permits the lubrication of rotor supports, such as bushings 145 disposed in each bushing plate 155, 160. In turn, the fluid lubricated bushings 145 remove the need for elastomeric seals in the motor 100, thereby allowing the motor 100 to operate in a high temperature wellbore environment without the possibility of motor failure due to damaged elastomeric seals. The end feed arrangement of the vane motor 100 will be discussed in greater detail in subsequent paragraphs.

As illustrated, a restriction, such as a nozzle 205, may be employed in the center bore 165 to control the flow of fluid therethrough. More specifically, the nozzle 205 may be selected based upon a predetermined nozzle diameter to create a known backpressure as a predetermined flow rate is pumped through the motor 100. In other words, the nozzle 205 controls the amount of fluid flowing through the center bore 165, thereby controlling the amount of fluid entering the chamber in the split flow arrangement. Furthermore, by splitting the flow less fluid passes through the chamber and thus resulting in a lower revolution per minute of output for the vane motor 100 as well as providing less flow and less debris contacting chamber components.

The nozzle 205 may be further used as a stall indicator. For instance, if the vane motor 100 stalls, which means that the rotor 125 is no longer rotating, all the fluid must flow through the nozzle 205. In this respect, the nozzle 205 may be selected based upon a predetermined nozzle diameter to create a predetermined backpressure to indicate when the vane motor 100 is stalled. In other words, the operator knows that the predetermined pressure is generated when the vane motor 100 is stalled or not operating and a different predetermined pressure is generated during normal operation. Furthermore, the nozzle 205 still provides a fluid pathway through the vane motor 100 even when the rotor 125 is no longer rotating, thereby providing an outlet for the fluid and minimizing damage to the plurality of vanes as well as other downhole equipment.

The selection of the nozzle 205 may be used to set an upper limit stall pressure based upon the max flow rate and working fluid density of the fluid. Generally, the stall pressure is a fluid pressure that acts on the plurality of vanes when the rotor 125 is not rotating. In other words, even though no fluid flows through the chamber when the rotor 125 is not rotating, a fluid pressure still acts on the plurality of vanes based upon the backpressure generated by the nozzle 205. In this respect, the stall pressure can be selected prior to disposing the vane motor 100 in the wellbore by selecting an appropriate nozzle 205 based upon the maximum flow rate used which will result in less damage to the plurality of vanes.

In the split flow arrangement of the vane motor 100, particles or other solids in the fluid may flow through the center bore 165 while clean fluid flows into the chamber. Often times, abrasive particles are introduced into the fluid prior to being pumped from the surface of the wellbore in order to maintain fluid properties and aid the drill bit in forming the wellbore. In the split flow arrangement, these particles will travel through the center bore 165 and bore 170 straight to the drill bit. This eliminates the need of a downhole filtering device disposed above the vane motor 100. To further ensure that the particles will not enter the chamber, a mesh material, such as a screen, may be placed proximate the inlet 130.

In the split flow arrangement of the vane motor 100, a ball (not shown) may be dropped or pumped from the surface of the wellbore through the drill string (not shown) and vane motor 100 to operate a downhole tool (not shown). More specifically, the center bore 165 provides a pathway for the ball through the vane motor 100. In this respect, the downhole tool below the vane motor 100 may be actuated by the ball without affecting the operation of the motor 100.

Traditionally, excess flow was diverted above the vane motor and power section. The fluid is therefore being bypassed several feet above the drill bit (not shown). The advantage in the vane motor 100 is that all of the flow can be used to clean and aid in cuttings removal. In other words, in the split flow arrangement in the vane motor 100, high flow rates may be pumped through the drill string without diverting excess flow above the vane motor 100. More specifically, the diameter of the nozzle 205 may be selected to allow a large portion of fluid to flow through the motor 100 to perform a downhole operation, such as removing cuttings downhole or cooling the rotating bit.

Figure 3:
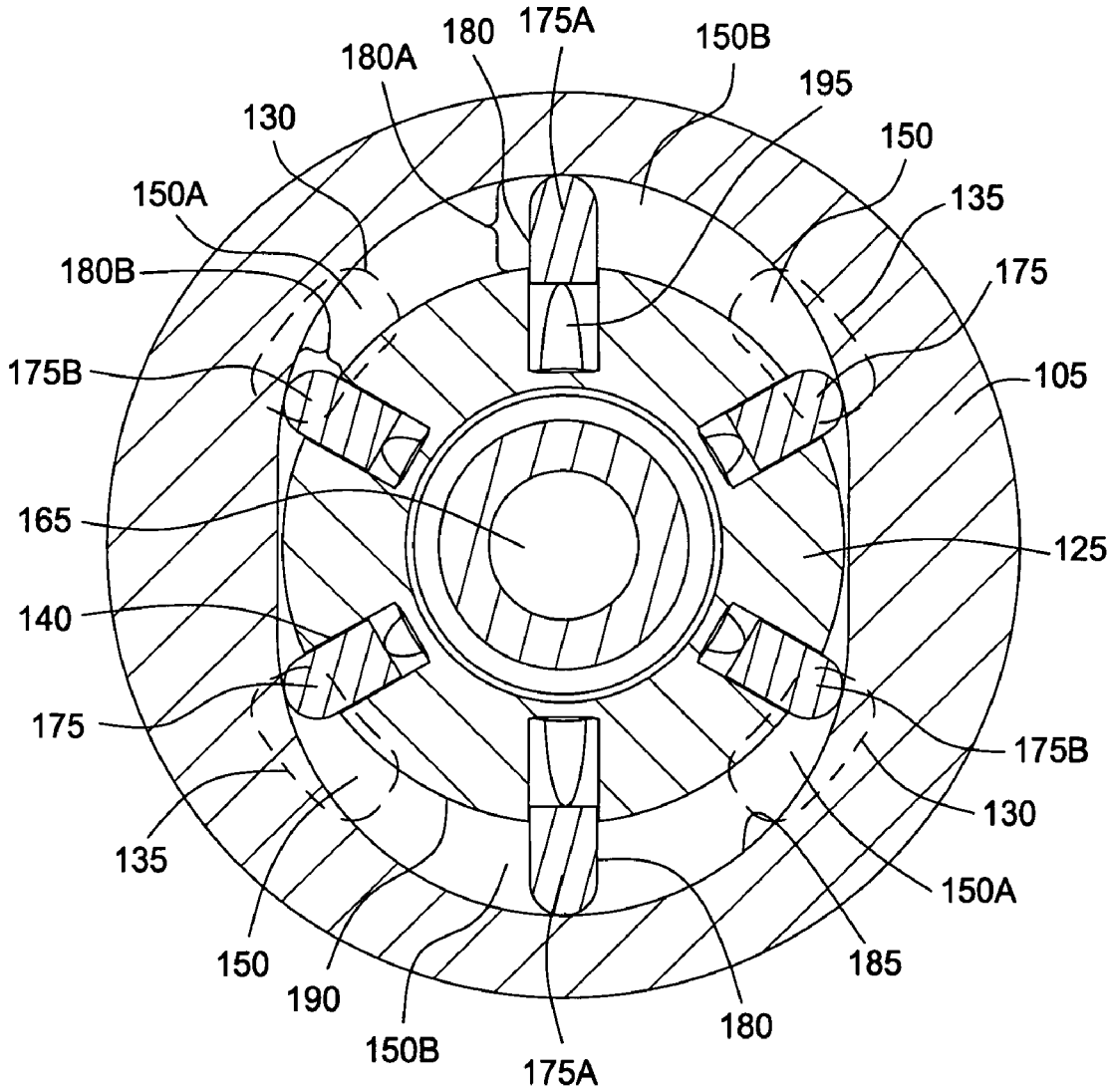
FIG. 3 is a cross-sectional view of the vane motor taken along line 3—3 of FIG. 2 illustrating the vane motor having a housing with an elliptical internal bore.

FIG. 3 is a cross-sectional view taken along line 3—3 of FIG. 2. As illustrated, a plurality of extendable members or vanes 175 are equally spaced around the rotor 125. The vanes 175 are movable between a retracted position in which they are substantially contained within a plurality of profiles 140 formed in the rotor 125 and an extended position, as illustrated by vane 175A, in which they substantially project from an outer surface 190 of the rotor 125. The vanes 175 are typically biased outward by a biasing member 195, such as a spring. Alternatively, the vanes 175 may be biased outward by fluid pressure from the center bore 165 that is directed through a plurality of ports (not shown) formed in the rotor 125. In another embodiment, the vanes 175 may be biased outward by both the biasing member 195 and the fluid pressure from the center bore 165.

Preferably, each vane 175 is constructed of a hard abrasive resistant material, such as a metallic material. However, another material may be employed, such as a composite, so long as the material is capable of withstanding an abrasive chamber environment. Furthermore, each vane 175 has a non-circular shape, such as a polygon, rectangle or any other shape that will create a differential surface area. Although the vane motor 100 in FIG. 3 illustrates six individual vanes 175, any number of vanes may be employed without departing from principles of the present invention.

As clearly shown, an annular space is defined between the outer surface 190 of the rotor 125 and a shaped inner bore 185 of the stator housing 105. Rotation and power are developed by the differential area created by the varying bore geometry of the stator housing 105 and the diameter of the rotor 125. In the embodiment illustrated in FIG. 3, the annular space is divided into two chambers 150. However, any number of chambers may be employed without departing from principles of the present invention. As shown, the chambers 150 are symmetrical resulting in a balanced arrangement that substantially eliminates side loading on the rotor 125. It should be further noted that the geometry of shaped inner bore 185 is not limited to a cylindrical bore but rather the shaped inner bore 185 can be altered to any shape that will provide a differential area for the fluid to act upon without departing from principles of the present invention. Likewise, the shape of the rotor 125 is not limited to the shape illustrated, but can be altered to provide improved fluid flow or add controlling effects to the charging cycle of the design.

As previously discussed, the chambers 150 are fluidly connected to the inlet 130 and the outlet 135 to form a substantially axial fluid pathway for passage of fluid through the vane motor 100. In the embodiment illustrated, there are two inlets 130 and two outlets 135. However, any number of inlets 130 and outlets 135 may be employed without departing from principles of the present invention. Furthermore, the orientation of the inlet 130 relative to the outlet 135 may be adjusted to control the intake and exhaust cycles of the vane motor 100. Generally, high pressure fluid from the non rotating drill string is pumped through the inlets 130 into the chambers 150 to cause the rotor 125 to rotate. After a predetermined amount of rotation, the fluid exits through the outlet 135. More particularly, the biasing member 195 urges the vanes 175 radially outward into contact with the shaped inner bore 185 of the stator housing 105 to form a seal therebetween. Furthermore, the centrifugal force acting on the vanes 175 due to rotation will further reinforce positive contact between the vanes 175 and the shaped inner bore 185.

As fluid enters through the inlet 130, the fluid fills the chamber 150 on one side of the vane 175A to create a high pressure chamber 150A while on the other side of the vane 175A is a low pressure chamber 150B. Thus, the fluid pressure in the high pressure chamber 150A acts upon a net surface area 180 on the extended vane 175A to create a moment force on the rotor 125, which causes the rotor 125 to rotate. The net surface area 180 is defined as the difference between a surface 180A and a surface area 180B which is between the outer surface 190 and the shaped inner bore 185. In other words, as fluid enters through the inlet 130, the fluid acts on both of the surface areas 180A and 180B which results in a differential area defined as the net surface area 180.

As the rotor 125 rotates, the other pair of vanes 175B are in a more retracted position in the profiles 140 by the shaped inner bore 185 of the stator housing 105. Rotation and power are developed by the differential area or the net surface area 180 created by the varying bore geometry of the stator housing 105 and the diameter of the rotor 125. The net surface area 180 is biased in the direction of rotation. Furthermore, as the rotor 125 rotates, an upper portion of the vanes 175 rub against the shaped inner bore 185 of the stator housing 105, thereby removing any particles or other dirt that may build up on the surface of the shaped inner bore 185. In other words, the vane motor 100 includes a self cleaning feature that removes excess particles and dirt from the chamber 150 which are subsequently flushed through the outlet 135 and discarded from the vane motor 100 along with the other fluid.

A separate stator, which is commonly used in prior art vane motors to direct fluid into the chamber, is not required in the vane motor 100 of the present invention because of the end feed arrangement. This arrangement permits the space once used by the stator to be utilized for other purposes, such as increasing the net surface area 180 as defined between the outer surface 190 and the shaped inner bore 185 that is exposed to the fluid pressure which results in a greater torque capability for the motor 100. In essence, the increase in the net surface area 180 increases the moment arm which is defined as the distance between the center of the net surface area 180 and the centerline of rotation, thereby increasing the torque. In the same respect, by increasing the net surface area 180, the volume of the at least one chamber 150 also increases which will result in a decrease of the speed of the vane motor 100. In other words, since the vane motor 100 utilizes the end feed arrangement, the need for a separate stator is not required, thereby allowing the available space to be used to increase the net surface area 180 and the volume of the chamber 150 which results in a decrease in speed and an increase of torque output. In this respect, the increased torque capability and decreased speed of the vane motor 100 reduces the need for greater lengths of the vane motor 100 as compared to prior art vane motors of equivalent size. Furthermore, the non-circular shape of the vanes 175 permit the greater extension of the vanes 175 thus creating a greater net surface area 180 and the larger moment arm resulting in a lower rpm and greater torque output. Additionally, if so desired, the performance characteristics of the vane motor 100 may also be adjusted by lengthening the power section, thus creating a longer net surface area 180 and increased chamber volume. By controlling these parameters, speed and torque output may also be controlled.

As the rotor 125 rotates under the influence of the fluid pressure in the high pressure chamber 150A, the retracted vanes 175B will clear the thicker portion of the shaped inner bore 185 and subsequently move to their extended position in the chamber 150. At the same time, high pressure fluid enters through the inlet 130 into the chamber 150, thereby once again establishing the high pressure chamber 150A and the low pressure chamber 150B to cause the rotor 125 to rotate. In this manner, fluid pressure entering through the inlet 130 provides a continuous driving and rotating force on the rotor 125 with a torque directly proportional to the pressure difference in the fluid in the high pressure chamber 150A and the low pressure chamber 150B. The fluid in the low pressure chamber 150B captured between the advancing extended vanes 175A and the stator housing 105 is subsequently expelled through the outlet 135.

Figure 4:
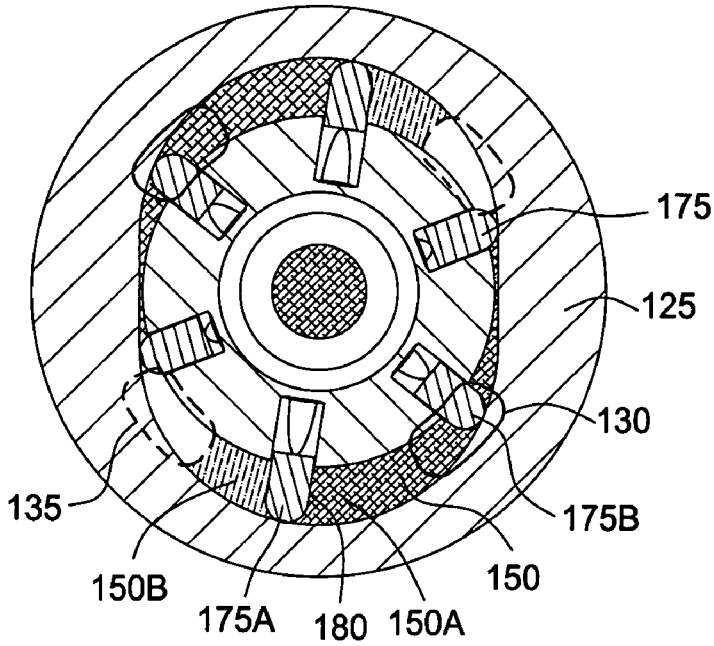
FIG. 4 is a cross-sectional view of the vane motor taken along line 4—4 of FIG. 2 illustrating an inlet and an outlet relative to a plurality of vanes.

FIG. 4 is a cross-sectional view taken along line 4—4 of FIG. 2 illustrating the inlet 130 and the outlet 135 relative to the plurality of vanes 175. As stated in a previous paragraph, the vane motor 100 of the present invention includes the end feed arrangement to fill and exhaust fluid from the chamber 150. As clearly shown on FIG. 4, fluid will enter through the inlet 130 and travel through the chamber 150 and subsequently exit the outlet 135, which is illustrated in dashed lines. To fully explain the concept of the end feed arrangement, FIGS. 4 and 4A–4E will briefly describe a partial cycle of rotation for the vane motor 100 of the present invention. It should be noted, however, that these Figures illustrate one embodiment of the vane motor 100 having two inlets 130, two outlets 135 and six vanes 175. Alternative embodiments may include any number of vanes 175, inlets 130, and outlets 135 without departing from principles of the present invention. Furthermore, the orientation of the inlets 130 relative to the outlets 135 may be adjusted to control the intake and exhaust cycles of the vane motor 100 and rotation direction. For clarity, the partial cycle of rotation will be described as it relates to vanes 175, 175A and 175B. Since this embodiment illustrates a balanced arrangement as previously discussed, the other vanes will function in a similar manner. For convenience, the rotation of the rotor 125 will be described and shown as clockwise in direction. It should be noted, however, the rotor 125 may be rotated in another direction, such as counterclockwise, without departing from principles of the present invention.

As shown in FIG. 4, a high pressure fluid 210 enters through inlet 130. The vanes 175 and 175A fluidly seal the high pressure chamber 150A, thereby preventing any leakage of high pressure fluid 210 into the outlet 135. At the same time, a low pressure fluid 215 on one side of the vane 175A exhausts through the outlet 135. As the high pressure fluid 210 acts on the net surface area 180 of the vane 175A, which is referred to as a leading vane, the rotor 125 rotates in a clockwise manner.

Figure 4A:
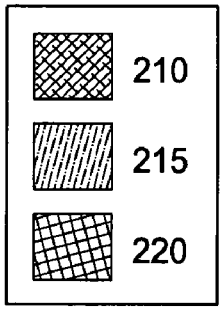
FIGS. 4A to 4E are cross-sectional views illustrating the plurality of vanes at various stages during an operational cycle of the vane motor.
Figure 4A:
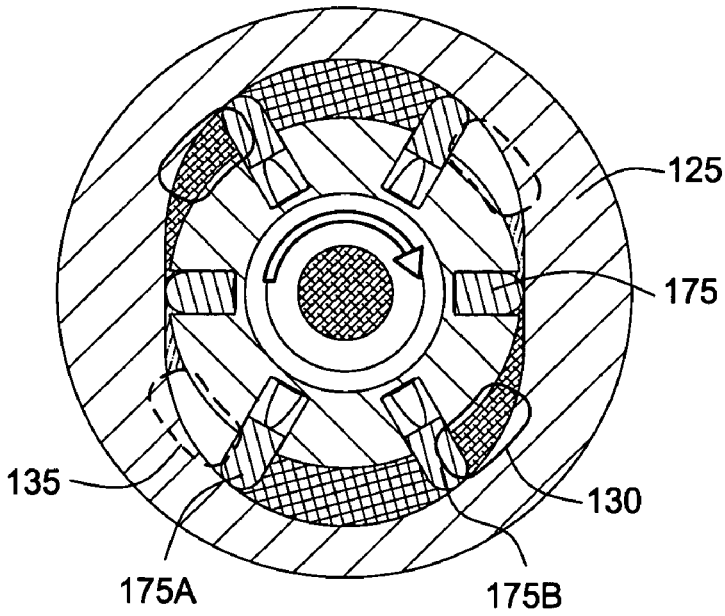

As illustrated in FIG. 4A, the rotor 125 has rotated clockwise moving the vane 175B passed the inlet 130. After a volume of fluid is used to rotate the rotor 125, the fluid becomes a dead fluid 220. Generally, the dead fluid 220 is no longer at a high pressure and therefore unable to effectively act on the vane 175A. At the same time, high pressure fluid 210 continues to enter through the inlet 130 causing the next vane 175B to become the leading vane. As further shown in FIG. 4A, the low pressure fluid 215 is substantially exhausted through the outlet 135.

Figure 4B:
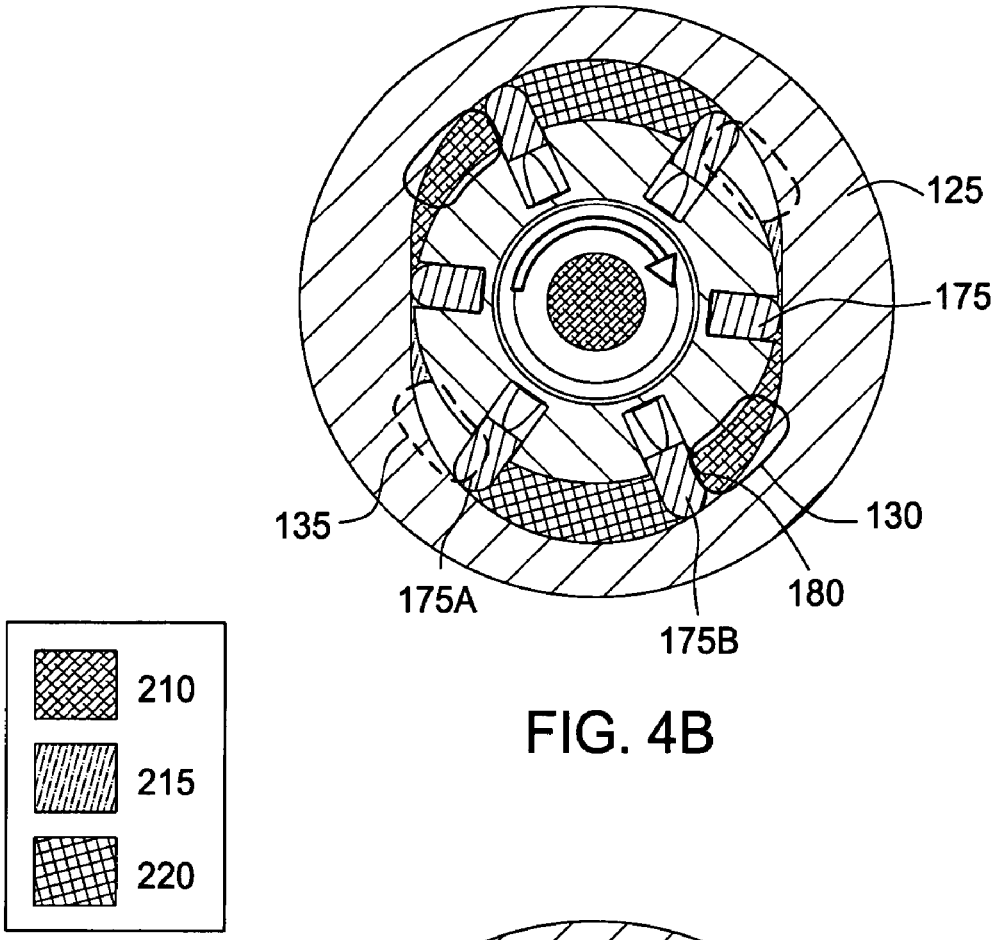

As illustrated in FIG. 4B, the leading vane 175B has cleared the inlet 130 and the dead fluid 220 creates a buffer between the high pressure fluid 210 and the outlet 135 to ensure no leakage there between. At the same time, the high pressure fluid 210 acts upon the net surface area 180 of the vane 175B to continue the clockwise rotation of the rotor 125. It should be noted, however, that the dead fluid 220 is an optional feature. Therefore, the motor 100 may operate exclusive of the dead fluid 220 without departing from principles of the present invention.

Figure 4C:
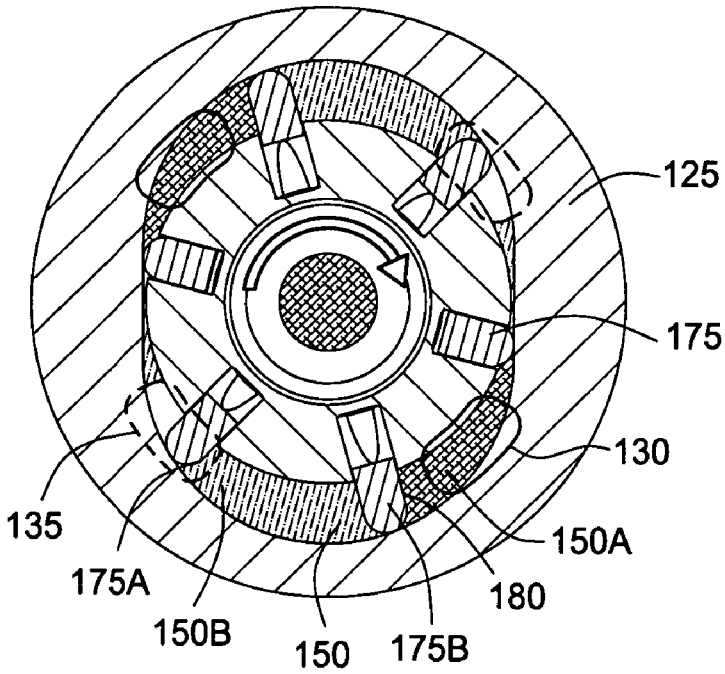

As illustrated in FIG. 4C, the dead fluid 220 between vanes 175A and 175B begin to exhaust into the outlet 135 and thereby turns into a low pressure fluid 215. At the same time, the high pressure fluid 210 in the high pressure chamber 150A continues to act on the net surface area 180 of the vane 175B, thereby continuing the clockwise rotation of the rotor 125.

Figure 4D:
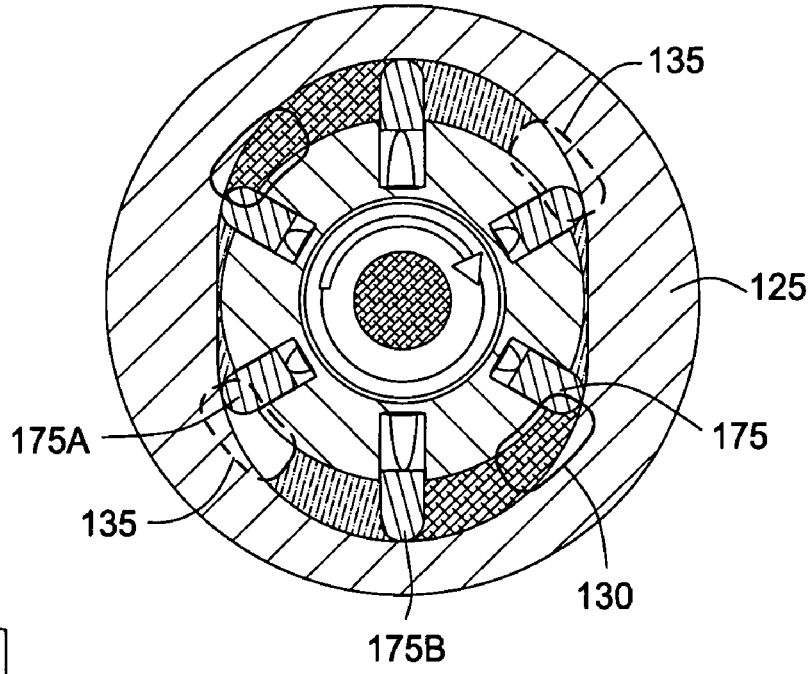
Figure 4D:
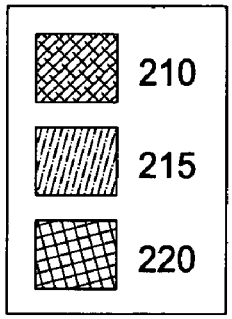

As illustrated in FIG. 4D, the high pressure fluid 210 continues to enter through the inlet 130 as the high pressure chamber 150A enlarges. At the same time, the low pressure fluid 215 continues to exhaust into the outlet 135.

Figure 4E:
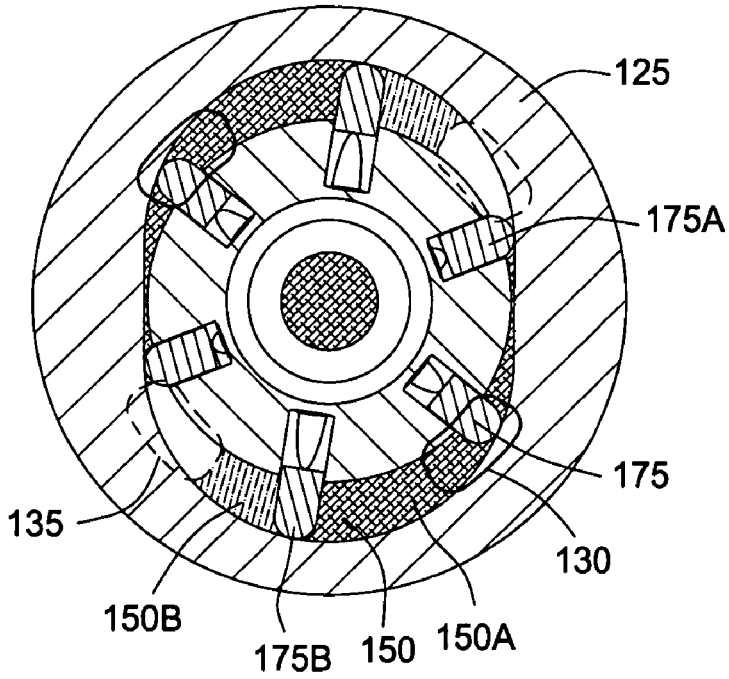

As illustrated in FIG. 4E, the partial cycle is complete, wherein once again, the vanes 175A and 175B fluidly seal the high pressure chamber 150A, thereby preventing any leakage of high pressure fluid 210 into the outlet 135. While at the same time, the lead vane 175B urges the rotor 125 in a clockwise direction.

Figure 5:
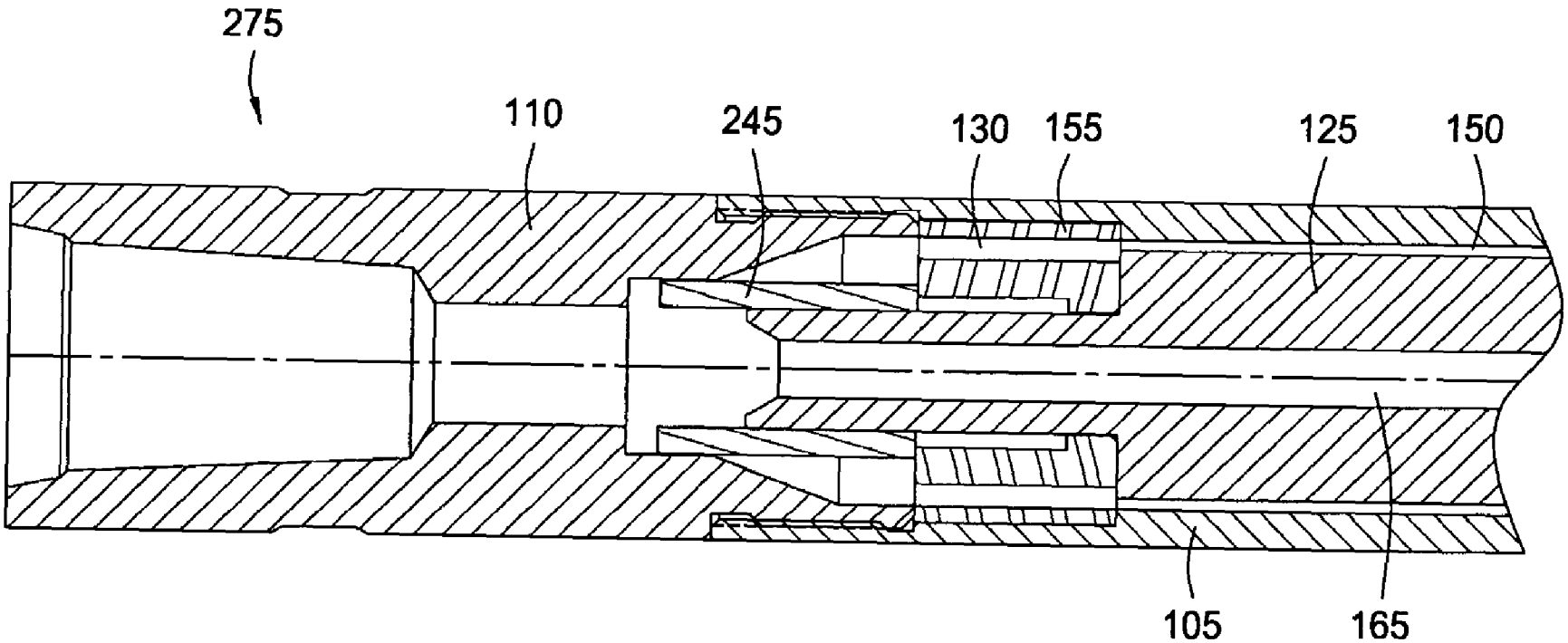
FIG. 5 is a cross-sectional view illustrating a screen disposed in a vane motor.

FIG. 5 is a cross-sectional view illustrating a screen 245 disposed in a vane motor 275. For convenience, the components in the vane motor 275 that are similar to the components in the vane motor 100 will be labeled with the same number indicator. Filtering of drilling mud and other fluids has become more important as down-hole devices become more technically advanced. Many down-hole tools require set limits on the size, shape or content of particles that they can tolerate in order to operate reliably at peak performance. Particle size and content are one of the major causes of erosion, wear, and failure of down-hole components. Therefore, the screen 245 is used to minimize the amount of particles from entering into the chamber 150 while allowing particles to freely pass through the center bore 165.

As discussed in a previous paragraph, a portion of the fluid travels through the inlet 130 into the chamber 150 and a portion of the fluid travels down the center bore 165 of the rotor 125. The screen 245 of this embodiment is designed to filter the portion of the fluid entering into the chamber 150. In other words, the screen 245 is designed to trap large particles in the ID of the screen 245 while preventing the particles from collecting and packing the screen 245. Particles not passing through the screen 245 migrate through the center bore 165, the nozzle (not shown) and subsequently are expelled from the vane motor 275.

Figure 6:
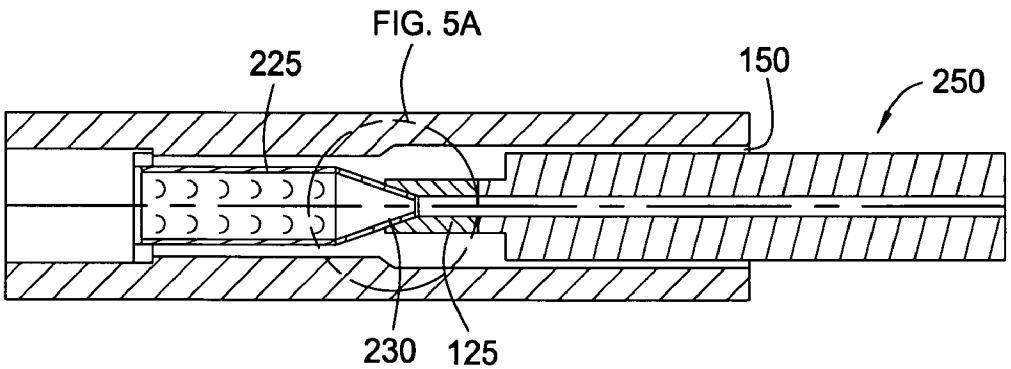
FIG. 6 is a cross-sectional view illustrating an alternative embodiment of a screen disposed in the vane motor.

FIG. 6 is a cross-sectional view illustrating an alternative embodiment of a screen 225 disposed in a vane motor 250. For convenience, the components in the vane motor 250 that are similar to the components in the vane motor 100 will be labeled with the same number indicator. As illustrated, fluid is pumped through the screen 225 prior to entering the vane motor 250. The screen 225 is designed to trap large particles in the ID of the screen 225 while preventing the particles from collecting and packing the screen 225. In other words, the screen 225 includes a self cleaning feature. More particularly, the screen 225 includes a conically shaped end for housing an adjustable nozzle 230. Alternatively, the nozzle 205 as previously described may be employed instead of the adjustable nozzle 230. Particles not passing through the screen 225 migrate to the nozzle 230 and are expelled from the screen 225 to an alternate flow path or bypassed to the outside of the vane motor 250. If the screen 225 fails to self clean, the operating pressure will increase until all flow is passing through the nozzle 230. This can be monitored at the surface as an indication that the filter section is inactive. Preferably, the nozzle diameter is sized based on particle size and pressure drop requirements. For this system to work efficiently, the nozzle diameter must be sized so that the screen 225 represents the lowest resistance to fluid flow.

Figure 6A:
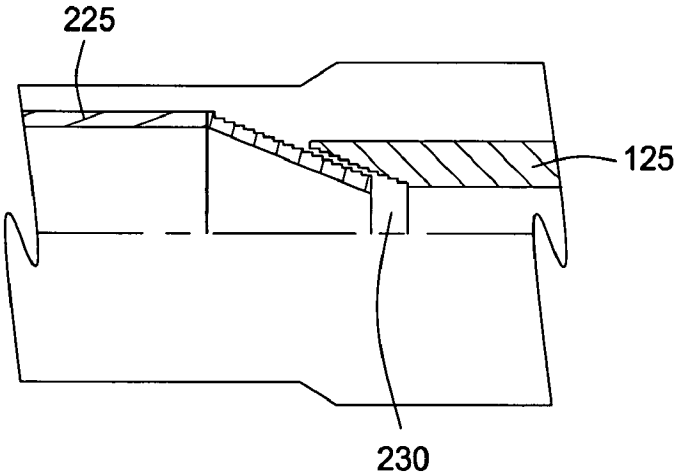
FIG. 6A is an enlarged view illustrating the interface of the screen and a rotor.

FIG. 6A is an enlarged view of the conical portion of the screen 225. The overlap between the rotor 125 and the conical portion of the screen 225 is necessary to provide a high resistance path to inhibit flow. This can also be adjusted to provide optimum filtering. Its main purpose is to prevent unfiltered flow from contaminating fluid that has already been filtered. Furthermore, the open nozzle arrangement also allows for the passage of balls to activate tools down stream of the device.

Figure 7:
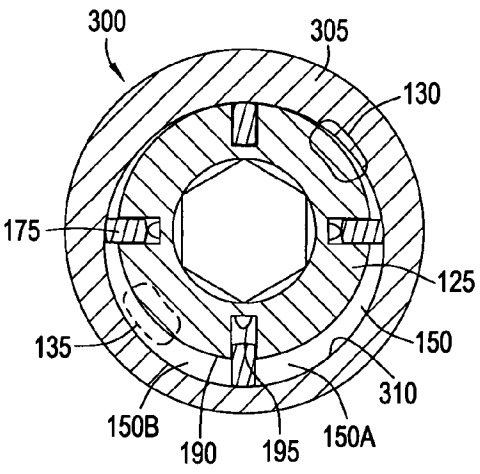
FIG. 7 is a cross-sectional view illustrating an alternative embodiment of the vane motor having a housing with an unbalanced internal bore.

FIG. 7 is a cross-sectional view illustrating an alternative embodiment of a vane motor 300 having a housing 305 with an offset internal bore 310. For convenience, the components in the vane motor 300 that are similar to the components in the vane motor 100 will be labeled with the same number indicator.

Similar to other embodiments, the housing 305 and the rotor 125 are positioned on the same axial centerline. However, in this embodiment, the housing 305 has an offset internal bore 310, which results in an unbalanced arrangement. In this arrangement, there is only one chamber 150 formed between the outer surface 190 of the rotor 125 and the offset internal bore 310. Furthermore, in the unbalanced arrangement, there is one inlet 130, one outlet 135, and four vanes 175. It should be noted, however, that any number of inlets, outlets, and vanes may be employed with this embodiment without departing from principles of the present invention.

The vane motor 300 utilizes the split flow arrangement and the end feed arrangement in a similar manner as previously discussed, The vanes 175 are urged radially outward to create a seal with the offset internal bore 310. At the same time, high pressure fluid from the inlet 130 fills the high pressure chamber 150A and acts upon the leading vane. In turn, the fluid pressure on the leading vane causes the rotor 125 to rotate. Simultaneously, fluid in the low pressure chamber 150B exits through the outlet 135. In this manner, the vane motor 300 operates in a continuous manner as high pressure fluid flowing into the chamber 150 causes the rotor 125 to rotate.

Figure 8:
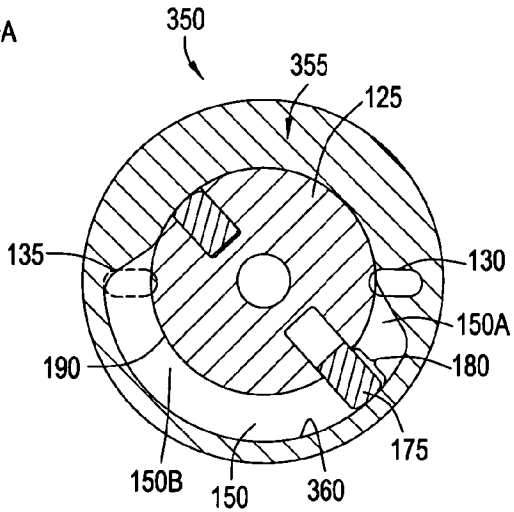
FIG. 8 is a cross-sectional view illustrating an alternative embodiment of the vane motor having a housing with an enlarged internal bore.

FIG. 8 is a cross-sectional view illustrating an alternative embodiment of the vane motor 350 having a housing with an enlarged internal bore 360. For convenience, the components in the vane motor 350 that are similar to the components in the vane motor 100 will be labeled with the same number indicator.

Similar to other embodiments, the housing 355 and the rotor 125 are positioned on the same axial centerline. However, in this embodiment, the housing 305 has the enlarged internal bore 360, which results in an enlarged net surface area 180 and an unbalanced arrangement. In this arrangement, there is only one chamber 150 formed between the outer surface 190 of the rotor 125 and the enlarged internal bore 310. Furthermore, there is one inlet 130, one outlet 135, and two vanes 175. It should be noted, however, that any number of inlets, outlets, and vanes may be employed with this embodiment without departing from principles of the present invention.

The vane motor 350 utilizes the split flow arrangement and the end feed arrangement in a similar manner as previously discussed. The vanes 175 are urged radially outward to create a seal with the enlarged internal bore 360. At the same time, high pressure fluid from the inlet 130 fills the high pressure chamber 150A and acts upon the leading vane. In turn, the fluid pressure on the leading vane causes the rotor 125 to rotate. Simultaneously, fluid in the low pressure chamber 150B exits through the outlet 135. In this manner, the vane motor 350 operates in a continuous manner as high pressure fluid flowing into the chamber 150 causes the rotor 125 to rotate.

Figure 9:
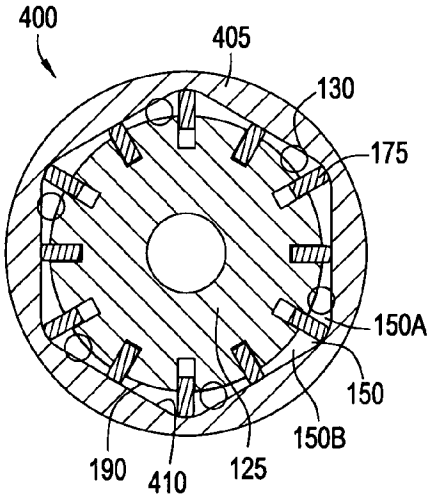
FIG. 9 is a cross-sectional view illustrating an alternative embodiment of the vane motor having a housing with a hexagon bore.

FIG. 9 is a cross-sectional view illustrating an alternative embodiment of the vane motor 400 having a housing with a hexagonal shaped internal bore 410. For convenience, the components in the vane motor 400 that are similar to the components in the vane motor 100 will be labeled with the same number indicator.

Similar to other embodiments, the housing 405 and the rotor 125 are positioned on the same axial centerline. However, in this embodiment, the housing 405 has the hexagonal shaped internal bore 410, which results in a plurality of chambers 150 formed between the outer surface 190 of the rotor 125 and the hexagonal shaped internal bore 410. Furthermore, there are a plurality of inlets 130 and a plurality of outlets (not shown). The vane motor 400 utilizes the split flow arrangement and the end feed arrangement in a similar manner as previously discussed. The vanes 175 are urged radially outward to create a seal with the hexagonal shaped internal bore 410. At the same time, high pressure fluid from the plurality of inlets 130 fill the high pressure chambers 150A and acts upon the leading vane. In turn, the fluid pressure on the leading vane causes the rotor 125 to rotate. Simultaneously, fluid in the low pressure chambers 150B exit through the plurality of outlets. In this manner, the vane motor 400 operates in a continuous manner as high pressure fluid flowing into the plurality of chambers 150 causes the rotor 125 to rotate.

Figure 10:
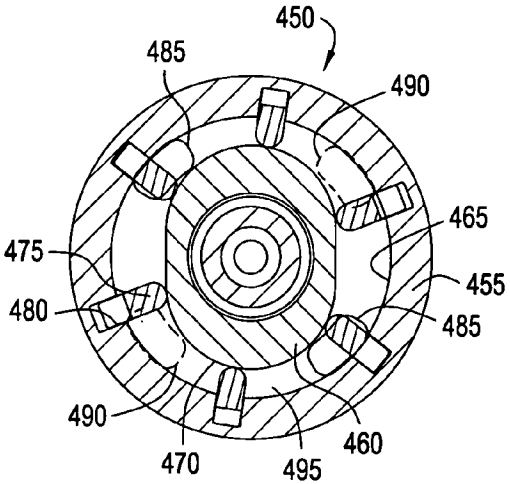
FIG. 10 is a cross-sectional view illustrating an alternative embodiment of a vane motor.

FIG. 10 is a cross-sectional view illustrating an alternative embodiment of a vane motor 450. Similar to other embodiments, the housing 455 and the rotor 460 are positioned on the same axial centerline. However, in this embodiment, the housing 455 has a substantially circular shaped internal bore 465 and the rotor 460 has a shaped outer surface 470. Furthermore, in this embodiment, a plurality of vanes 475 are disposed in a plurality of profiles 480 formed in the housing 455. The plurality of vanes 475 are biased radially inward. As further shown, the vane motor 450 includes inlets 485 and outlets 490. It should be noted, however, that any number of inlets, outlets, and vanes may be employed with this embodiment without departing from principles of the present invention.

In this embodiment, the inlets 485 and the outlets 490 are formed in plates (not shown) that are operatively attached to the rotor 460. Therefore, as the rotor 460 rotates about its axis so does the inlets 485 and the outlets 490. More particularly, as fluid is introduced through the inlet 485, a fluid pressure is created in a chamber 495 defined between the shaped outer surface 470 and the substantially circular shaped internal bore 465. The fluid pressure acts on the shaped outer surface 470 of the rotor 460 in the chamber 495, thereby causing the rotor 460 along with the inlets 485 and the outlets 490 to rotate. After a predetermined amount of rotation, the fluid exhausts through the outlets 490 while at the same time a subsequent chamber 495 fills with fluid. In this manner, the vane motor 450 operates in a continuous manner as high pressure fluid flowing into the chambers 495 causes the rotor 460 to rotate.

Figure 11:
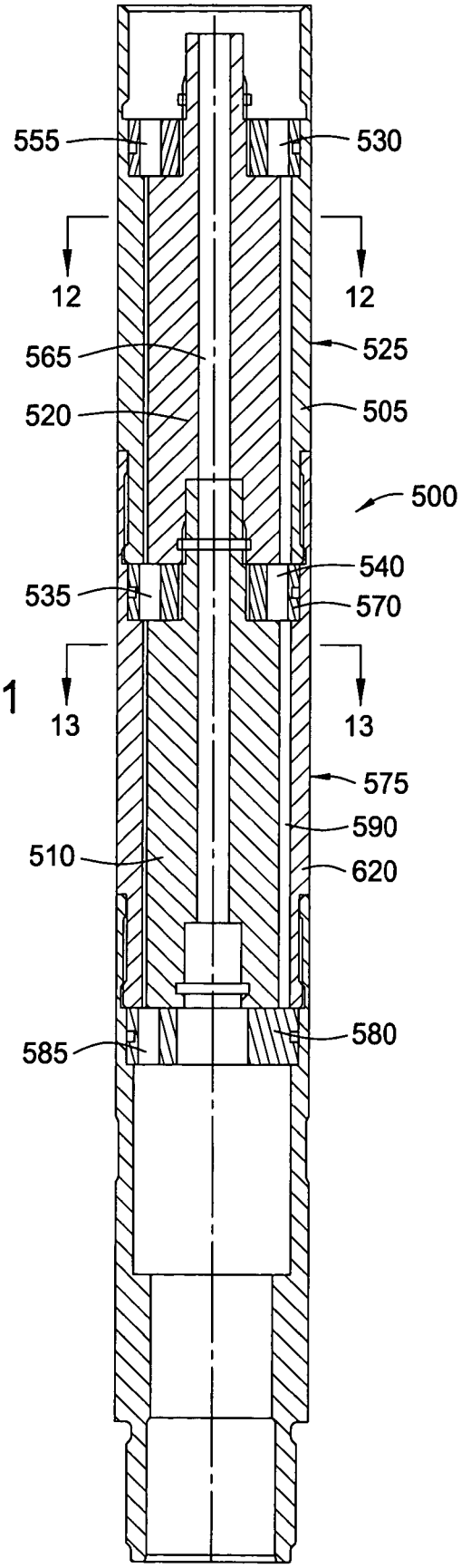
FIG. 11 is a cross-sectional view of a vane motor having a first power section and a second power section.

FIG. 11 is a cross-sectional view of a vane motor 500 having a first power section 525 and a second power section 575. For ease of explanation, the invention will be described generally in relation to the first power section 525 and the second power section 575. It is to be understood, however, that the invention may employ any number of power sections without departing from principles of the present invention.

In a similar manner as previously discussed in other embodiments, the vane motor 500 utilizes the end feed arrangement. However, in this embodiment, the end feed arrangement will be used to supply fluid to the first power section 525 and the second power section 575 in a parallel flow arrangement. In other words, high pressure fluid flowing into the vane motor 500 will fill the first power section 525 and the second power section 575 at the same time, as will be discussed in greater detail in subsequent paragraphs.

Similar to the other embodiments, the vane motor 500 includes the split flow arrangement, wherein a predetermined amount of fluid entering the motor 500 may be directed through an inlet 530 into a chamber 550 and a predetermined amount of fluid may be directed through the center bore 565. In this respect, the motor 500 may take advantage of the benefits of having the center bore 565 as previously discussed, such as pumping a ball or abrasive particles through the motor 500.

As fluid is pumped into the inlet 530 formed in a bushing plate 555, the fluid flows through the chamber 550 in the first power section 525 and into a second inlet 540 formed in a middle bushing plate 570 to fill a chamber 590 in the second power section 575. As more fluid is pumped through the inlet 530 both chambers 550, 590 become filled with high pressure fluid, thereby creating an instantaneous pressure distribution along the entire length of a plurality of vanes 605 in the first power section 525 and a plurality of vanes 610 in the second power section 575. The fluid pressure causes an upper rotor 520 and a lower rotor 510 to rotate about their axis. After, the rotors 510, 520 have rotated at a predetermined distance, the fluid in the chamber 550 exhausts through an outlet 535 formed in the bushing plate 570 and the fluid in the chamber 590 exhausts through an outlet 585 formed in a bushing plate 580. The process of filling and exhausting chambers 550, 590 is repeated throughout the operational cycle of the vane motor 500 to provide a continuous rotation of the rotors 510, 520.

Figure 12:
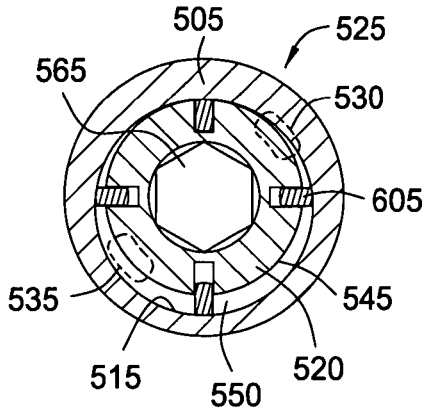
FIG. 12 is a cross-sectional view of the first power section taken along line 12—12 of FIG. 11.

FIG. 12 is a cross-sectional view of the first power section 525 taken along line 12—12 of FIG. 11. As illustrated, the housing 505 has an offset internal bore 515, which results in an unbalanced arrangement. In this arrangement, there is only one chamber 550 formed between the outer surface 545 of the rotor 520 and the offset internal bore 515. Furthermore, in the unbalanced arrangement, there is one inlet 530, one outlet 535, and four vanes 605. It should be noted, however, that any number of inlets, outlets, and vanes may be employed with this embodiment without departing from principles of the present invention. The second power section 575 has a similar arrangement as the first power section 525.

Figure 13:
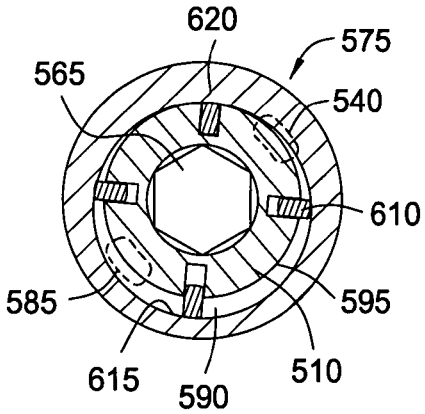
FIG. 13 is a cross-sectional view of the second power section taken along line 13—13 of FIG. 11.

FIG. 13 is a cross-sectional view of the second power section 575 taken along line 13—13 of FIG. 11. As illustrated, the housing 620 has an offset internal bore 615, which results in an unbalanced arrangement. In this arrangement, there is only one chamber 590 formed between the outer surface 595 of the rotor 510 and the offset internal bore 615. Similar to FIG. 12, in the unbalanced arrangement, there is one inlet 540, one outlet 585, and four vanes 610. It should be noted, however, that any number of inlets, outlets, and vanes may be employed with this embodiment without departing from principles of the present invention.

While the foregoing is directed to embodiments of the present invention, other and further embodiments of the invention may be devised without departing from the basic scope thereof, and the scope thereof is determined by the claims that follow.

The invention claimed is:

1. A method of rotating a downhole tool, comprising:
- placing a tubular string having a motor therein, the motor comprising:
  - a housing having a shaped inner bore;
  - a rotor having a plurality of extendable members disposed on the outer surface thereof;
  - a first fluid pathway through the downhole tool, wherein the fluid pathway includes at least one inlet, at least one outlet and at least one chamber formed between the shaped inner bore and the rotor; and
  - a second fluid pathway through the downhole tool, wherein the second fluid pathway is separate from the first fluid pathway;
- extending the members into the at least one chamber to form a differential surface area between an outer surface of the rotor and the shaped inner bore;
- pumping fluid through the at least one inlet to pressurize the at least one chamber;
- creating a force on a substantially flat differential surface area, thereby causing the rotor to rotate;
- exhausting fluid through the at least one outlet; and
- pumping a ball through the second fluid pathway to an area below the motor.

2. The method of claim 1, further including indicating that the motor is stalled when the motor is not operating.

3. The method of claim 1, further including diverting fluids containing particles and/or solids through the second fluid pathway.

4. The method of claim 1, further including selectively diverting clean fluids through the first fluid pathway.

5. The method of claim 1, further including pumping a predetermined amount of fluid through the first fluid pathway and pumping a second predetermined amount of fluid through the second fluid pathway.

6. The method of claim 1, further including wiping the shaped inner bore with the plurality of members as the rotor rotates.

7. The method of claim 1, wherein the plurality of extendable members are polygon shaped.

8. The method of claim 1, wherein the plurality of extendable members are rectangular shaped.

9. The method of claim 1, further including a rotor support disposed at either end of the rotor, wherein the rotor support is lubricated by fluid communicated through the fluid pathway.

10. The method of claim 1, further including urging the plurality of members radially outward by pumping fluid through a plurality of holes formed in the rotor.

11. The method of claim 1, wherein the plurality of extendable members are non-circular members and are movable between an extended position and a retracted position.

12. The method of claim 1, wherein each extendable member is biased radially outward by a biasing member.

13. The method of claim 1, further including a restriction disposed in the second fluid pathway to control the flow of fluid therethrough.

14. The method of claim 13, wherein a predetermined back pressure created by the restriction indicates the operating condition of the downhole tool.

15. A method of rotating a downhole tool, comprising:
- placing a tubular string having a motor therein, the motor comprising:
  - a housing having a shaped inner bore;
- a rotor having a plurality of extendable members disposed on the outer surface thereof;
- a first fluid pathway through the downhole tool, wherein the fluid pathway includes at least one inlet, at least one outlet and at least one chamber formed between the shaped inner bore and the rotor; and
- a second fluid pathway through the downhole tool, wherein the second fluid pathway is separate from the first fluid pathway;
- diverting fluids containing particles and/or solids through the second fluid pathway;
- extending the members into the at least one chamber to form a differential surface area between an outer surface of the rotor and the shaped inner bore;
- pumping fluid through the at least one inlet to pressurize the at least one chamber;
- creating a force on a substantially flat differential surface area, thereby causing the rotor to rotate; and
- exhausting fluid through the at least one outlet.

16. The method of claim 15, further including indicating that the motor is stalled when the motor is not operating.

17. The method of claim 15, further including selectively diverting clean fluids through the first fluid pathway.

18. The method of claim 15, further including wiping the shaped inner bore with the plurality of members as the rotor rotates.

19. A tool for use in a wellbore, comprising:
- a housing having a shaped inner bore;
- a rotor having a plurality of extendable members disposed on the outer surface thereof, wherein the rotor is disposed in the shaped inner bore and the extendable members are configured to form a differential surface area between an outer surface of the rotor and the shaped inner bore upon extension of the members;

a first fluid pathway through the tool, wherein the fluid pathway includes at least one inlet, at least one outlet and at least one chamber formed between the shaped inner bore and the rotor; and a second fluid pathway through the tool, the second fluid pathway is separate from the first fluid pathway, wherein the first fluid pathway and the second fluid pathway are configured such that fluids containing particles and/or solids are diverted through the second fluid pathway.

20. The tool of claim 19, wherein the shaped inner bore includes at least one rounded edge.

21. The tool of claim 19, wherein the rotor includes at least three extendable members.

22. The tool of claim 19, wherein the plurality of extendable members are polygon shaped.

23. The tool of claim 19, wherein the plurality of extendable members are rectangular shaped.

24. The tool of claim 19, wherein the plurality of extendable members are capable of wiping the shaped inner bore as the rotor rotates.

25. The tool of claim 19, further including a rotor support disposed at either end of the rotor, wherein the rotor support is lubricated by fluid communicated through the fluid pathway.

26. The tool of claim 19, wherein the down hole tool includes a split flow arrangement, whereby a predetermined amount of fluid is communicated into the first fluid pathway and a predetermined amount of fluid is communicated through the second pathway.

27. The tool of claim 19, wherein the second fluid pathway comprises a bore formed in the rotor.

28. The tool of claim 19, wherein the bore is constructed and arranged to allow a ball to pass through the downhole tool.

29. The tool of claim 19, further Including a restriction disposed in the second fluid pathway to control the flow of fluid therethrough.

30. The tool of claim 19, wherein a predetermined back pressure created by the restriction indicates the operating condition of the downhole tool.

31. The tool of claim 19, wherein each extendable member is biased radially outward by a biasing member.

32. The downhole tool of claim 19, further including a plurality of holes formed in the rotor, whereby a fluid in the second fluid pathway flows through the plurality of holes to bias the plurality of members radially outward.

33. The downhole tool of claim 19, wherein the plurality of extendable members are non-circular members.

* * * * *